US009666401B2

(12) United States Patent
Park et al.

(10) Patent No.: US 9,666,401 B2
(45) Date of Patent: May 30, 2017

(54) FIELD-EMISSION DEVICE WITH IMPROVED BEAMS-CONVERGENCE

(71) Applicant: ELECTRONICS AND TELECOMMUNICATIONS RESEARCH INSTITUTE, Daejeon (KR)

(72) Inventors: So Ra Park, Seoul (KR); Yoon Ho Song, Daejeon (KR); Jin Woo Jeong, Daejeon (KR); Jae Woo Kim, Daejeon (KR); Min Sik Shin, Daejeon (KR)

(73) Assignee: ELECTRONICS AND TELECOMMUNICATIONS RESEARCH INSTITUTE, Daejeon (KR)

( * ) Notice: Subject to any disclaimer, the term of this patent is extended or adjusted under 35 U.S.C. 154(b) by 0 days.

(21) Appl. No.: 14/929,792

(22) Filed: Nov. 2, 2015

(65) Prior Publication Data

US 2016/0148774 A1 May 26, 2016

(30) Foreign Application Priority Data

Nov. 21, 2014 (KR) ..... 10-2014-0163859
Sep. 11, 2015 (KR) ..... 10-2015-0129016

(51) Int. Cl.
*H01J 21/10* (2006.01)
*H01J 3/02* (2006.01)
*H01J 29/46* (2006.01)
*H01J 19/24* (2006.01)

(52) U.S. Cl.
CPC ..... *H01J 3/021* (2013.01); *H01J 29/46* (2013.01); *H01J 29/467* (2013.01); *H01J 2203/0216* (2013.01); *H01J 2203/0232* (2013.01)

(58) Field of Classification Search
USPC ..... 257/10
See application file for complete search history.

(56) References Cited

U.S. PATENT DOCUMENTS 8,547,299 B2 10/2013 Jeong et al.
2006/0052026 A1* 3/2006 Ra ..... H01J 9/025 445/50
2006/0202608 A1* 9/2006 Chen ..... H01J 29/06 313/495
2009/0039754 A1* 2/2009 Tolt ..... H01J 3/022 313/310
2010/0244717 A1* 9/2010 Jeong ..... G09G 3/22 315/246
2013/0169142 A1* 7/2013 Hyde ..... H01J 3/021 313/296
2013/0313980 A1* 11/2013 Cheatham, III ..... H01J 33/00 315/161

FOREIGN PATENT DOCUMENTS

KR 10-2014-128975 A 11/2014
WO WO 2013/101937 7/2013

* cited by examiner

*Primary Examiner* — Jaehwan Oh
*Assistant Examiner* — Lawrence Tynes, Jr.

(57) ABSTRACT

The present disclosure may provide a field emission device with an enhanced beam convergence. For this, the device may include a gate structure disposed between a cathode electrode and an anode electrode, wherein the gate structure includes a gate electrode and an atomic layer sheet disposed on the gate electrode, the gate electrode facing an emitter and having at least one aperture formed therein.

10 Claims, 10 Drawing Sheets

FIELD-EMISSION DEVICE WITH IMPROVED BEAMS-CONVERGENCE

CROSS-REFERENCE TO RELATED APPLICATION

The present application claims priority to Korean patent application number 10-2014-0163859 filed on Nov. 21, 2014 and 10-2015-0129016 filed on Sep. 11, 2015, the entire disclosure of which is incorporated herein in its entirety by reference.

BACKGROUND

Field

The present disclosure relates to a field emission device, and, in particular, to a field emission device with a multiple-electrodes configuration.

Related Arts

The field emission emitter has been employed in a variety of devices including displays, engineering or medical X-ray tubes, etc. A performance of such devices may depend on characteristics of electron-beams from the emitter, including a beam convergence, current density, or etc.

The diode-configured field emission device with two electrodes has cathode and anode electrodes, where the cathode electrode has an emitter attached thereto to emit electrons. In a field emission, it may require comparatively large field strength due to a large spacing between the cathode and anode electrodes. This may lead to a difficulty to control the emitted electron-beams.

To solve this problem, there has been set forth the triode-configured field emission device having cathode and anode electrodes and one additional electrode, where using the additional electrode, a current amount as emitted, an electron-beams size, electron-beams convergence may be controlled.

The additional electrode is formed in a meshed-structure with apertures to transmit the electrons. Thus, the electrons emitted from the emitter may reach more efficiently the anode electrode. In this time, structural features of the additional electrode such as the apertures size and arrangement, etc. may affect field emission characteristics of the device. For example, the larger aperture size may lead to a larger effective amount of currents reaching from the emitter through the additional electrode to the anode. However, such a large aperture size may lead to a reduced gate field effect applied to the emitter via a distortion of a potential distribution between the additional electrode and cathode electrode. This may result in a reduced initial electron emission and thus a reduced current amount as emitted.

Therefore, there may a need for an electron material to allow effective controls of the electron-beams size and convergence while providing a high electron transmittance therethrough and a high gate field effect.

SUMMARY

The present disclosure may provide, in one aim thereof, a field emission device to allow effective controls of the electron-beams size and convergence while providing a high electron transmittance and a high gate field effect.

In accordance with one implementation of the present disclosure, there is provided a field emission device; a cathode electrode; at least one emitter on the cathode electrode; an anode electrode disposed away in a longitudinal direction of the device from the cathode electrode; and a gate structure disposed between the cathode electrode and the anode electrode, wherein the gate structure includes a gate electrode and an atomic layer sheet disposed on the gate electrode, the gate electrode facing the emitter and having at least one aperture formed therein.

The atomic layer sheet may be configured as a free-standing 2D atomic layer physically strained due to the aperture. In one embodiment, the atomic layer sheet may be implemented in a graphene layer(s). This may lead to an Electron Transmissive Atomic Network Gate (ETANG) structure where the gate structure includes the 2D atomic layer. This ETANG structure may result in a reduction of a potential distribution distortion around the aperture. Further, the electron-beams convergence may be improved via a curvedness of the atomic layer sheet in the aperture region.

BRIEF DESCRIPTIONS OF THE DRAWINGS

A brief description of each drawing is provided to more fully understand the drawings, which is incorporated in the detailed description of the invention.

FIG. 1A to FIG. 1C collectively illustrate a configuration of a field emission device in accordance with one implementation of the present disclosure.

DETAILED DESCRIPTIONS

Figure 1A:
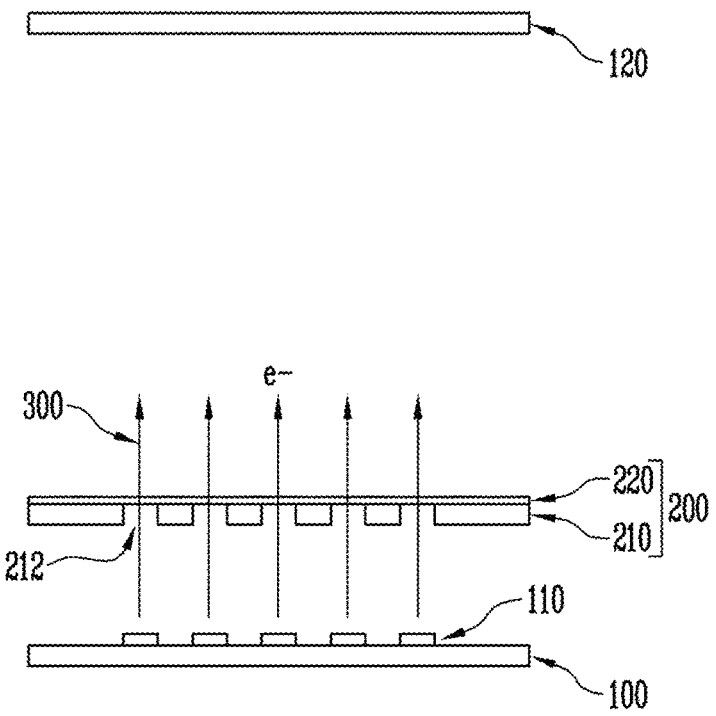

Examples of various embodiments are illustrated in the accompanying drawings and described further below. It will be understood that the discussion herein is not intended to limit the claims to the specific embodiments described. On the contrary, it is intended to cover alternatives, modifications, and equivalents as may be included within the spirit and scope of the present disclosure as defined by the appended claims.

Example embodiments will be described in more detail with reference to the accompanying drawings. The present disclosure, however, may be embodied in various different forms, and should not be construed as being limited to only the illustrated embodiments herein. Rather, these embodiments are provided as examples so that this disclosure will be thorough and complete, and will fully convey the aspects and features of the present disclosure to those skilled in the art.

It will be understood that, although the terms "first", "second", "third", and so on may be used herein to describe various elements, components, regions, layers and/or sections, these elements, components, regions, layers and/or sections should not be limited by these terms. These terms are used to distinguish one element, component, region, layer or section from another element, component, region, layer or section. Thus, a first element, component, region, layer or section described below could be termed a second element, component, region, layer or section, without departing from the spirit and scope of the present disclosure.

It will be understood that when an element or layer is referred to as being "connected to", or "coupled to" another element or layer, it can be directly on, connected to, or coupled to the other element or layer, or one or more intervening elements or layers may be present. In addition, it will also be understood that when an element or layer is referred to as being "between" two elements or layers, it can be the only element or layer between the two elements or layers, or one or more intervening elements or layers may also be present.

The terminology used herein is for the purpose of describing particular embodiments only and is not intended to be limiting of the present disclosure. As used herein, the singular forms "a" and "an" are intended to include the plural forms as well, unless the context clearly indicates otherwise. It will be further understood that the terms "comprises", "comprising", "includes", and "including" when used in this specification, specify the presence of the stated features, integers, s, operations, elements, and/or components, but do not preclude the presence or addition of one or more other features, integers, s, operations, elements, components, and/or groups thereof. As used herein, the term "and/or" includes any and all combinations of one or more of the associated listed items. Expression such as "at least one of" when preceding a list of elements may modify the entire list of elements and may not modify the individual elements of the list.

Unless otherwise defined, all terms including technical and scientific terms used herein have the same meaning as commonly understood by one of ordinary skill in the art to which this inventive concept belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

In the following description, numerous specific details are set forth in order to provide a thorough understanding of the present disclosure. The present disclosure may be practiced without some or all of these specific details. In other instances, well-known process structures and/or processes have not been described in detail in order not to unnecessarily obscure the present disclosure.

Hereinafter, the various embodiments of the present disclosure will be described in details with reference to attached drawings.

Figure 1B:
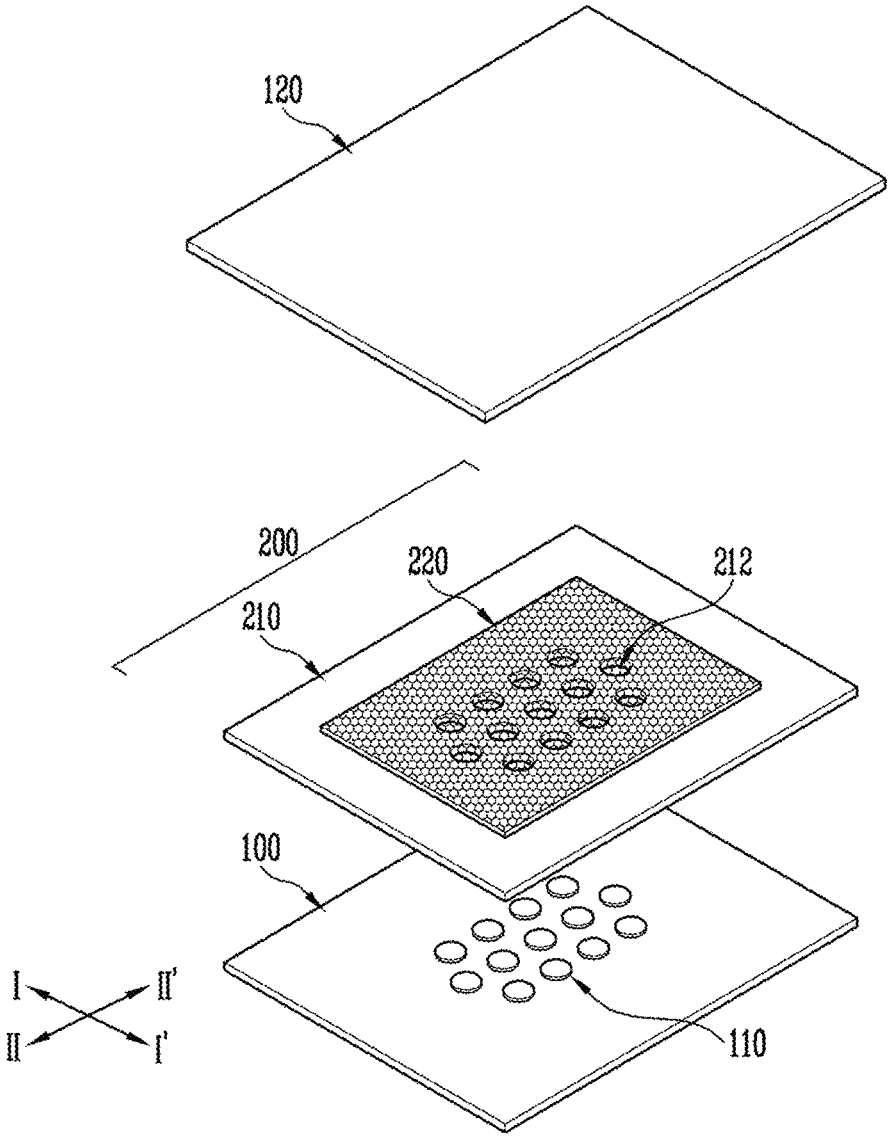
Figure 1C:
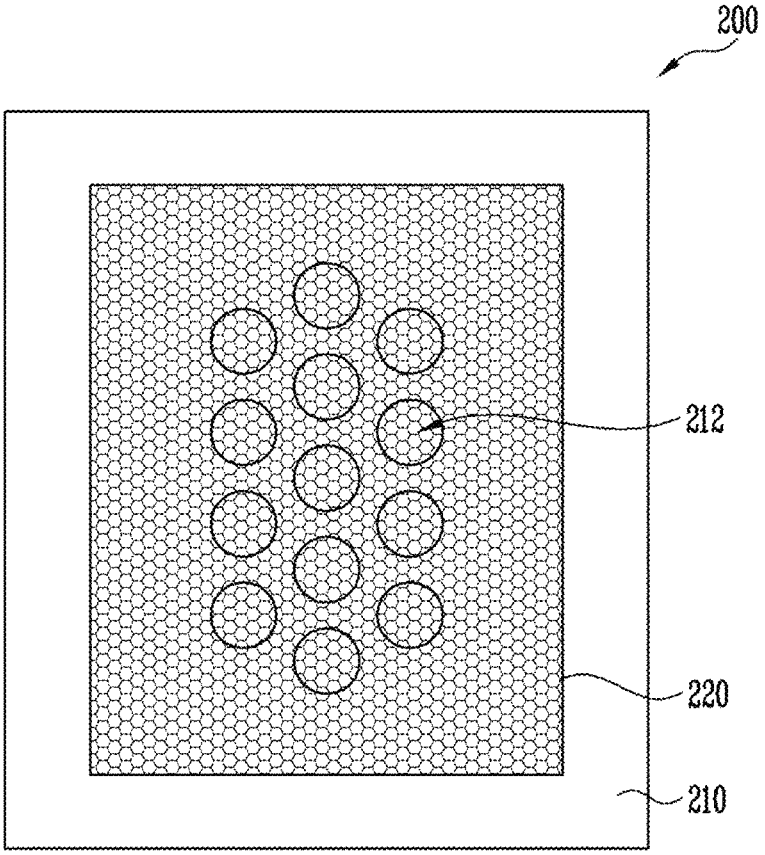

FIG. 1A to FIG. 1C collectively illustrate a configuration of a field emission device in accordance with one implementation of the present disclosure. FIG. 1A is a cross-sectional view of the device, FIG. 1B is perspective view thereof, and FIG. 1C is a plan view of a gate structure of the device.

Referring to FIG. 1A, a field emission device in accordance with one implementation of the present disclosure may include a cathode electrode 100, at least one emitter 110, an anode electrode 120 and a gate structure 200. This device may operate in a vacuum system such as a vacuum chamber or a vacuum-sealed tube being in a pressure state to allow of the field emission effect. Further, the field emission device may be implemented in a three-electrode (triode) or more-electrodes configuration.

At least one emitter 110 may emit electrons 300 when a field is applied across the cathode electrode 100, gate structure 200 and anode electrode 120. The emitter 110 may be attached to the cathode electrode 100 surface. The emitter may have an array form with plural sub-emitters to be arranged in a predetermined spacing. It may be appreciated that a type of a material, size, arrangement, thickness, etc. of the emitter 110 may vary depending on implementations.

The anode electrode 120 may be located in a longitudinal upper portion of the device than the cathode electrode 100. The gate structure 200 may be disposed between the cathode electrode 100 and anode electrode 120 to control electron-beams emitted from the emitter 110.

The gate structure 200 may include a gate electrode 210 and an atomic layer sheet 220 attached to the gate electrode 210. The gate electrode 210 may be made of a metal material and have at least one aperture 212 formed therein. The aperture 212 may have an array form of a plurality of apertures. The aperture 212 may have a size and an arrangement corresponding to those of the emitter 110. In case of an array form, the apertures 212 may have sizes and arrangement corresponding respectively to those of the emitters 110.

Electrons 300 may be derived via the gate structure 200 and then be emitted from the emitter 110 and then travel through the gate structure 200 and finally reach the anode electrode 120 with a higher applied voltage thereto than the gate structure 200. In the present disclosure, the electron 300 may run though the aperture 212 in the gate electrode 210 and then the atomic layer sheet 220.

The atomic layer sheet 220 may be formed on the gate electrode 210 toward the anode 120. The atomic layer sheet 220 may be implemented in an atomic monolayer of a 2D (two-dimension) atoms arrangement. In one example, the atomic layer sheet 220 may be implemented in a graphene sheet. The graphene may have a very high mechanical stability due to its tightly packed carbon atoms and an $sp^2$ orbital hybridization—a combination of orbitals s, $p_x$ and $p_y$ that constitute the σ-bond. The graphene sheet with a perfect geometrical structure may have an electronic structure to exhibit a linear energy distribution near the Fermi level. Thus, the graphene sheet may have a very high planar charge-mobility and hence a very low electrical resistance.

When the graphene sheet with the very low resistance is bonded to the gate electrode 210 to form the gate structure 200, the electrons emitted from the emitter 110 may not be accumulated on the structure 200, which, otherwise, may be disadvantageous. Due to a small RC time constant of the graphene sheet, a bandwidth gain may be achieved in a field emission using a pulse signal.

Referring to FIG. 1B, the aperture structure in the gate electrode 210 may be formed in an aperture array of plural apertures 112 which may be arranged in a given spacing. In one example, the plurality of apertures 212 may be arranged in a first direction I-I' and a second direction II-II' crossing the first direction. Centers of the neighboring apertures 212 may be arranged in a linear or non-linear shape. In one example, the centers of the neighboring apertures 212 in the first direction I-I' may be arranged in a non-linear shape (e.g., staggering), while the centers of the neighboring apertures 212 may be arranged in a linear or non-linear shape. In one example, the centers of the neighboring apertures 212 in the first direction I-I' may be arranged in a linear shape.

The plurality of apertures 212 may correspond respectively to a plurality of emitters 110 when the emitter structure is embodied in an array of the emitters. In particular, the plurality of apertures 212 may be superpositioned respectively with the plurality of the emitters 110. In an alternative, a single aperture 212 may cover all of the plurality of emitters 110. Alternatively, each of the plurality of apertures 212 may have substantially the same size as that of each of the plurality of emitters 110.

Referring to FIG. 1C, the atomic layer sheet 220 may be attached to an upper face of the gate electrode 210 so as to cover the apertures 212 in the gate electrode 210. The gate structure 200 may be divided into a combination of the aperture 212 and the atomic layer sheet 220 and a combination of the gate electrode 210 and the atomic layer sheet 220.

In this approach, in a position corresponding to the emitter 110, the atomic layer sheet 220 may face directly the emitter 110 without the gate electrode 210 therebetween.

The gate structure 200 may be formed by installing an already-formed atomic layer sheet 220 to the gate electrode 210. During the installation, the already-formed atomic layer sheet 220 may be subjected to a minimal damage. To this end, in one example, an atomic layer sheet 220 may be deposited on a substrate, and then be removed chemically or physically therefrom and then be moved toward the gate electrode 210. This process may be carried out for a single or multiple atomic monolayers to be bonded to the mesh-structured gate electrode 210. This may result to a suspended layer structure of the atomic layer sheet in the aperture 212 region, where the emitter 119 may directly face the suspended atomic layer.

Via the above-addressed configuration, the field emission device may employ as an electron emission-inducing gate electrode the gate structure 200 with an ETANG (electron transmissive atomic network gate) structure.

When the gate structure 200 does not include the atomic layer sheet 220 but only the gate electrode 210 having the apertures formed therein, the electrons emitted from the emitter 110 may be subjected to a lateral force due to a distorted potential distribution around the aperture 212. This may lead to a horizontal spread of the electron-beams trajectory. To the contrary, in accordance with one embodiment of the present disclosure, where the atomic layer sheet 220 is formed on the gate electrode 210 having apertures 212 formed therein, a potential distribution distortion between the gate electrode 200 and cathode electrode 100 may be suppressed. In this way, the electrons emitted from the emitter 110 may be subjected to an enhanced vertical force, resulting in suppression of the horizontal spread of the electron-beams trajectory which may occur in the former conventional device. That is, via the atomic layer sheet 220 contained in the gate structure 200, the present device may have an improved field emission characteristics relative to the conventional device without the atomic layer sheet 220.

Figure 2A:
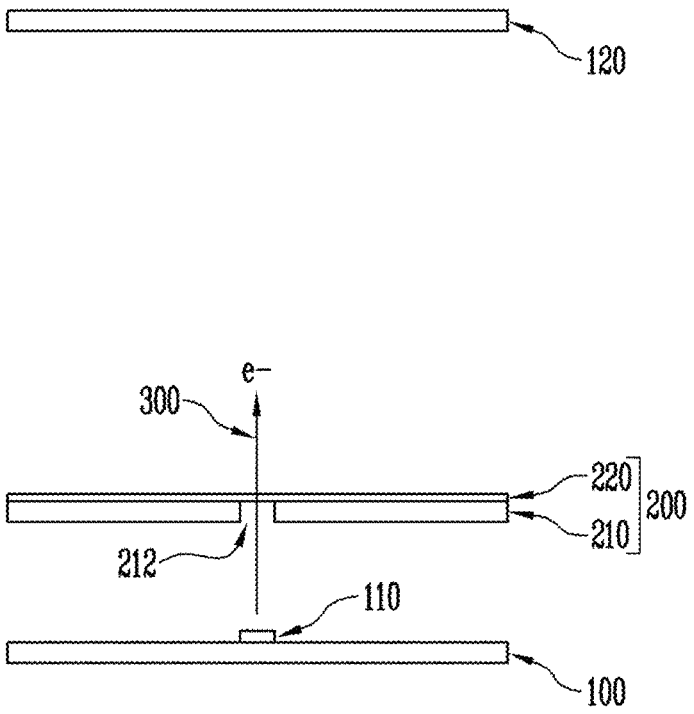
FIG. 2A to FIG. 2C illustrate a configuration of a field emission device in accordance with one implementation of the present disclosure.
Figure 2B:
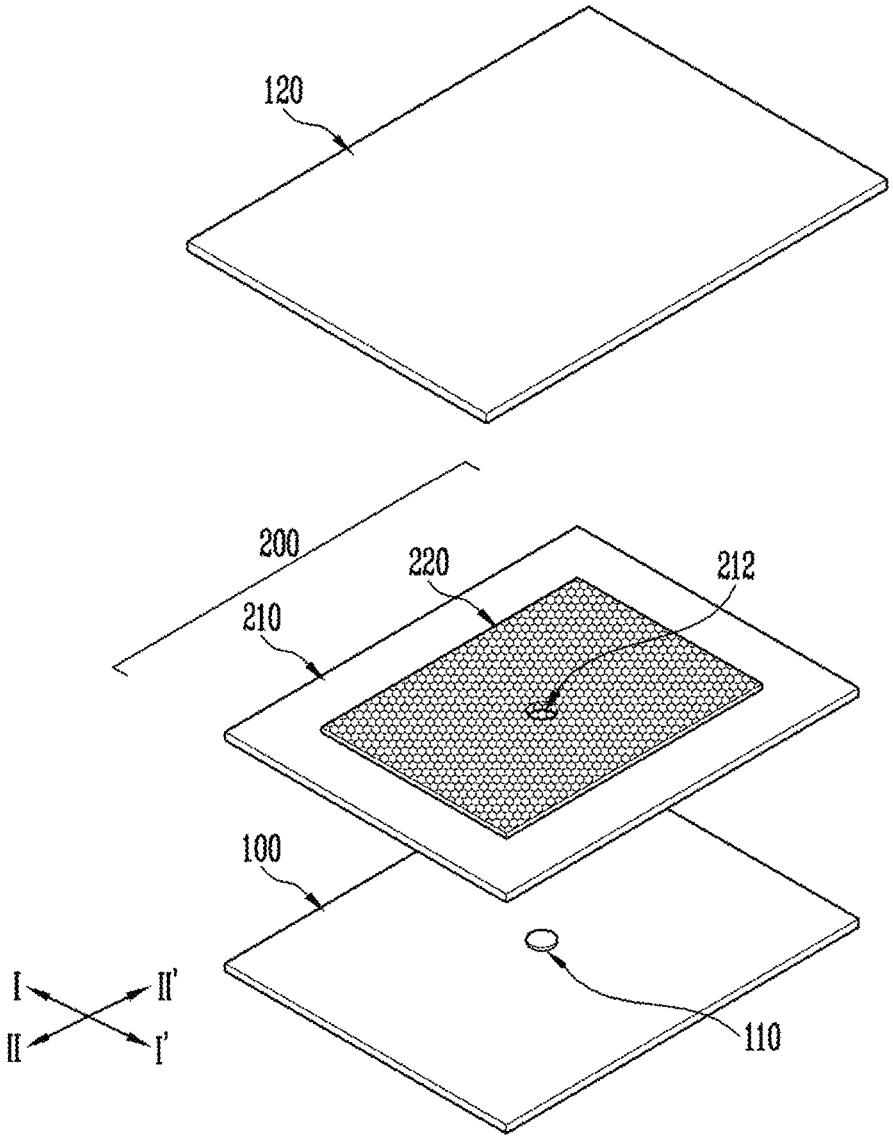
Figure 2C:
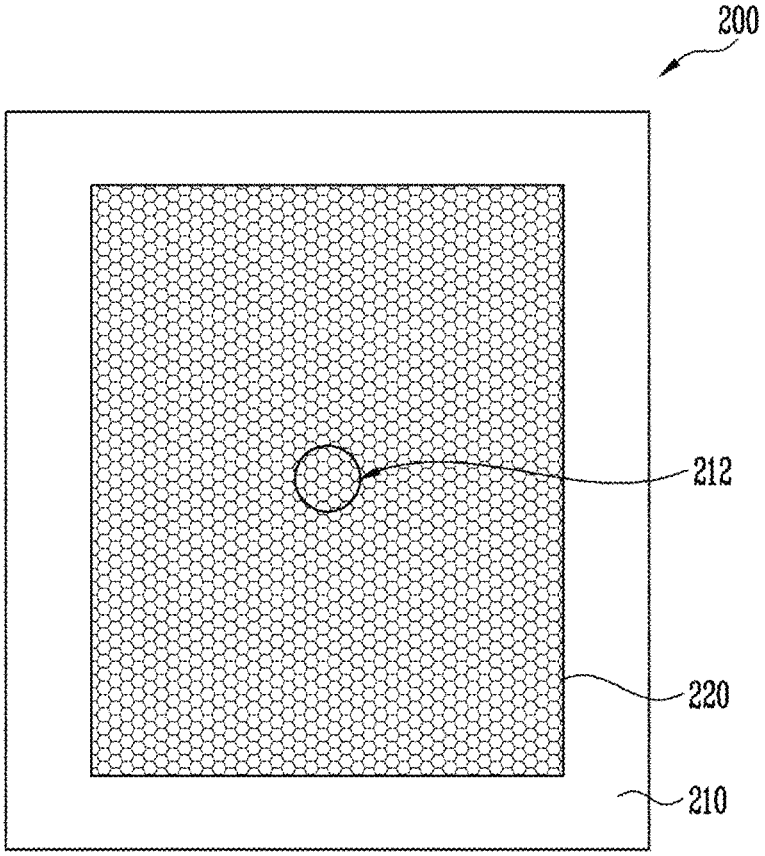

FIG. 2A to FIG. 2C illustrate a configuration of a field emission device in accordance with one implementation of the present disclosure. FIG. 2A is a cross-sectional view of the device, FIG. 2B is a perspective view of the device and FIG. 2C is a plan view of a gate structure of the device.

Referring to FIG. 2A to FIG. 2C, a single emitter 110 may be attached to the cathode electrode 110. Further, the gate electrode 210 may include a single aperture 212. The single aperture 212 may have a size and/or location correspondence with the single emitter 110. Except for the singleness, this embodiment may be identical, in the configuration, with the embodiment in FIG. 1A to FIG. 1C.

Figure 3:
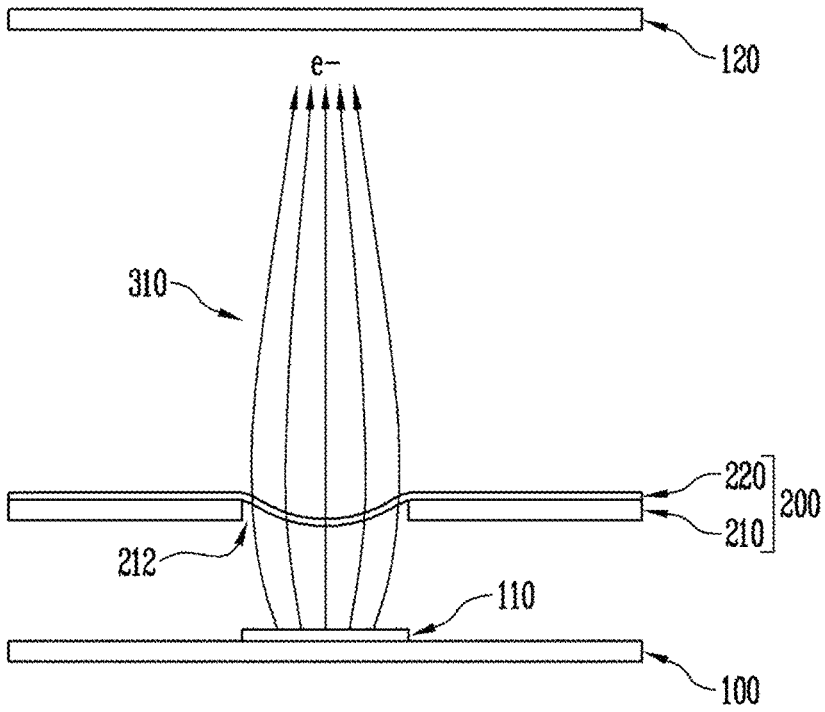
FIG. 3 is a cross-sectional view of a field emission device in accordance with one implementation of the present disclosure.

FIG. 3 is a cross-sectional view of a field emission device in accordance with one implementation of the present disclosure, in which an atomic layer sheet in an aperture region is downward-curved.

Referring to FIG. 3, the atomic layer sheet 220 in an aperture 212 region among the gate electrode 210 region may not be supported. Thus, a lateral shear force may be relatively smaller than a vertical downward-force, which may allow the aperture 212 to be bent downwards. This curved structure of the atomic layer sheet 220 may affect a potential distribution between the emitter 110 and gate structure 200, as well as near the gate aperture 212, when an electrical field is applied to the device including the gate structure 200. This affected potential distribution may be different from that in the conventional device. To be specific, the affected potential distribution may have a mitigated distortion around the aperture 212 to allow more converged electron-beams 310.

Figure 4A:
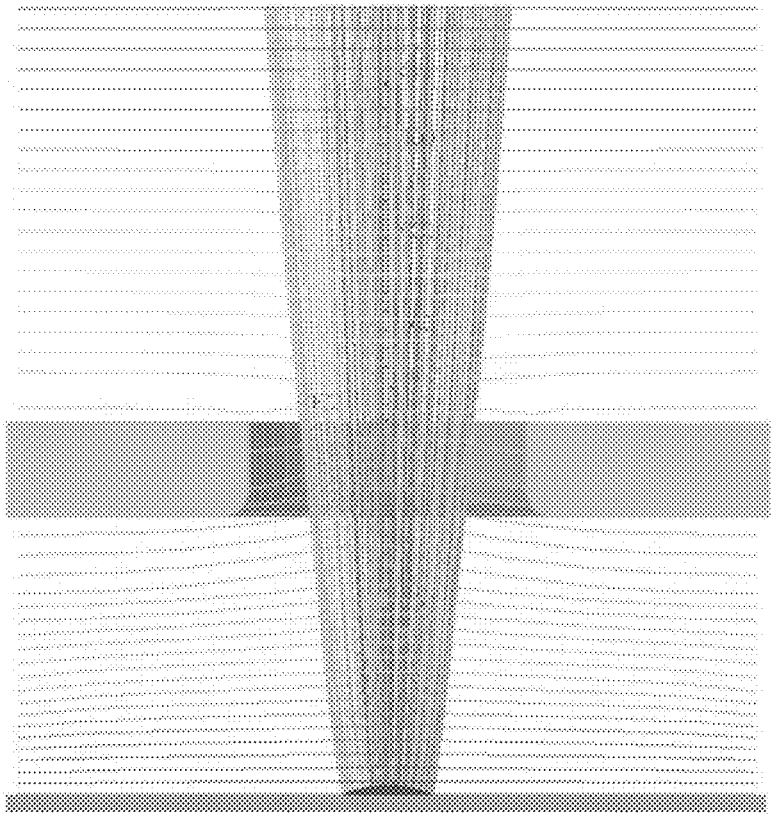
FIG. 4A to FIG. 4C illustrate electron-beams emissions of the field emission devices in accordance with the implementations of the present disclosure and the conventional device.
Figure 4B:
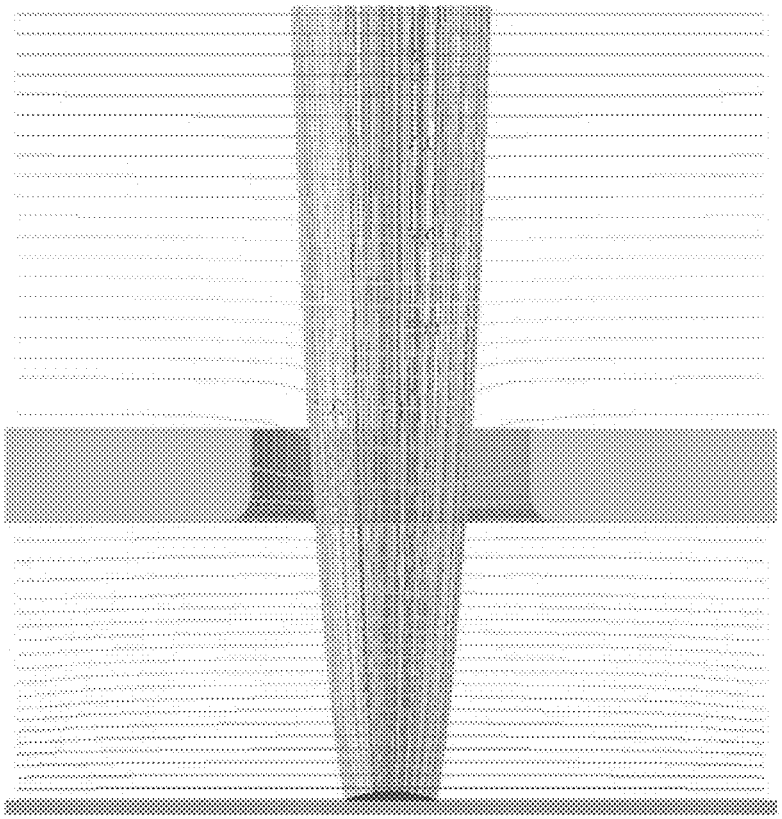
Figure 4C:
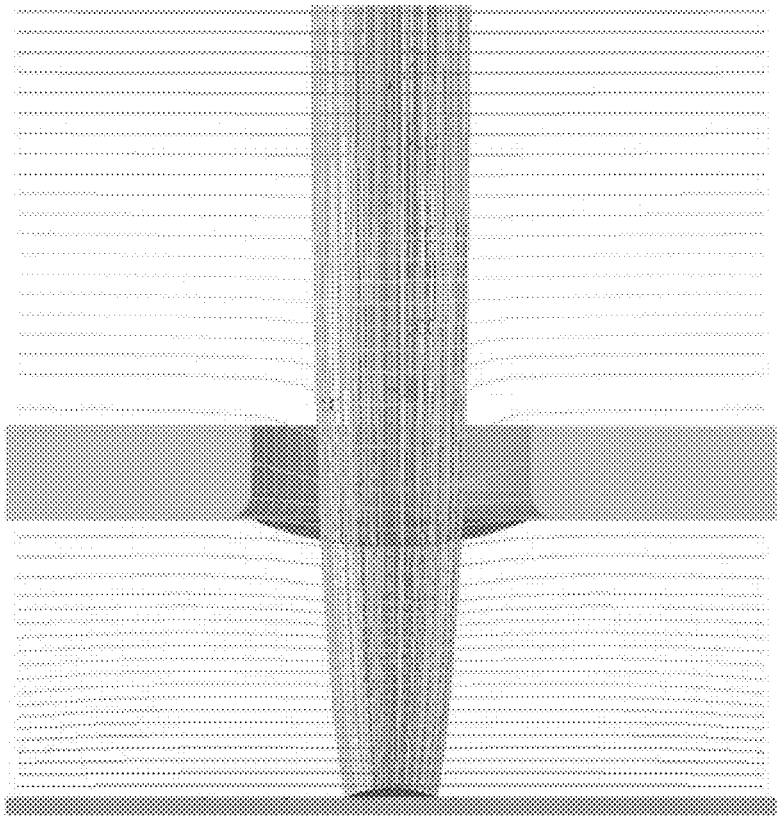

FIG. 4A to FIG. 4C illustrate electron-beams emissions of the field emission devices in accordance with the implementations of the present disclosure and the conventional device.

FIG. 4A illustrates a simulation of an electron-beams emission of a conventional field emission device with a meshed gate electrode. Using only the meshed gate electrode, as seen from FIG. 4A, the electrons emitted from the emitter may be subjected to a lateral force due to a distorted potential distribution around the aperture. This may lead to a horizontal spread of the electron-beams trajectory.

FIG. 4B and FIG. 4C illustrates respectively simulations of electron-beams emissions of the present field emission devices with gate structures in accordance with implementations of the present disclosure respectively. FIG. 4B shows a simulation of the emission of the device where the atomic layer sheet is planar in the aperture region, while, FIG. 4C shows a simulation of the emission of the device where the atomic layer sheet is curved in the aperture region.

Referring to FIG. 4B and FIG. 4C, via the atomic layer sheet included in the gate structure, a potential distribution with an improved electron-beam convergence may be achieved relative to that in the conventional device. This is, the potential distribution may have a less distortion between the emitter and gate structure, and, hence, the electrons emitted from the emitter may be more subjected to a vertical force rather than the lateral force. In this way, the trajectory horizontal spread of total electron-beams may be suppressed. The configuration where the atomic layer sheet is curved in the aperture region may lead to an enhanced electron-beams convergence.

Although the present disclosure has been described with reference to limited embodiments and drawings, the present disclosure is not limited thereto. The present disclosure may encompass variations and modifications thereto via the skilled person to the art.

Therefore, a scope of the present disclosure may not be limited to the embodiments as described above, but, rather, may be defined by following claims and their equivalents.

If desired, the different functions discussed herein may be performed in a different order and/or concurrently with each other. Furthermore, if desired, one or more of the above-described functions may be optional or may be combined. Although various aspects of the embodiments are set out in the independent claims, other aspects comprise other combinations of features from the described embodiments and/or the dependent claims with the features of the independent claims, and not solely the combinations explicitly set out in the claims.

It is also noted herein that while the above describes example embodiments of the invention, these descriptions should not be viewed in a limiting sense. Rather, there are several variations and modifications which may be made without departing from the scope of the present disclosure as defined in the appended claims.

What is claimed is:

1. A field emission device comprising:

a cathode electrode;

at least one emitter disposed on the cathode electrode;

an anode electrode spaced apart from the cathode electrode in a longitudinal direction; and a gate structure disposed between the cathode electrode and the anode electrode, the gate structure including a gate electrode comprising at least one aperture and an atomic layer sheet including graphene and covering the at least one aperture of the gate electrode.

2. The device of claim 1, wherein the at least one aperture comprises a plurality of apertures, and the at least one emitter comprises a plurality of emitters, and wherein each location the plurality of apertures corresponds to a respective location of the plurality of emitters.

3. The device of claim 2, wherein the atomic layer sheet curves over each of the apertures.

4. The device of claim 3, wherein the curved portions of the atomic layer sheet reduce a distortion of a potential distribution between the gate structure and the cathode electrode, so that electrons emitted from the emitters have an enhanced trajectory convergence.

5. The device of claim 1, wherein the at least one aperture comprises a plurality of apertures, and the at least one emitter comprises a plurality of emitters, and wherein each size the plurality of apertures corresponds to a respective size of the plurality of emitters.

6. The device of claim 1, wherein the atomic layer sheet includes a graphene sheet.

7. The device of claim 1, wherein the atomic layer sheet reduces a distortion of a potential distribution of electrons near the gate aperture and between the gate structure and the cathode electrode.

8. The device of claim 1, wherein the gate electrode induces an electron emission from the emitter.

9. The device of claim 1, wherein the at least one emitter comprises a plurality of emitters, and the at least one aperture includes a single aperture that exposes all of the plurality of emitters.

10. The device of claim 1, wherein the at least one aperture entirely exposes the at least one emitter.

* * * * *